US007090272B2

(12) United States Patent
Novakovich et al.

(10) Patent No.: US 7,090,272 B2
(45) Date of Patent: Aug. 15, 2006

(54) ERGONOMIC PLASTIC BAG HANDLE

(75) Inventors: Jeffrey Paul Novakovich, Scottsdale, AZ (US); John Emile Mosca, Scottsdale, AZ (US); Ronald Wayne Riley, Carefree, AZ (US)

(73) Assignee: Add-A-Handle, Inc., Scottsdale, AZ (US)

( * ) Notice: Subject to any disclaimer, the term of this patent is extended or adjusted under 35 U.S.C. 154(b) by 0 days.

(21) Appl. No.: 11/160,391

(22) Filed: Jun. 22, 2005

(65) Prior Publication Data

US 2005/0285421 A1 Dec. 29, 2005

Related U.S. Application Data

(60) Provisional application No. 60/584,949, filed on Jun. 25, 2004.

(51) Int. Cl.
*A45F 5/10* (2006.01)

(52) U.S. Cl. ..... 294/171; 294/137

(58) Field of Classification Search ..... 294/137, 294/170, 171; 16/406, 425; D9/434, 455; 229/117.09, 117.19
See application file for complete search history.

(56) References Cited

U.S. PATENT DOCUMENTS 874,515 A 12/1907 Lorenz
1,819,142 A 8/1931 Wily
2,004,396 A 6/1935 Sage
2,846,134 A 8/1958 Moubayed
3,688,935 A 9/1972 Owen et al.
4,590,640 A 5/1986 Enersen
4,871,264 A 10/1989 Robbins, III et al.
4,902,060 A 2/1990 Nobakht
4,923,235 A 5/1990 Stewart
D317,246 S 6/1991 Driscoll
5,029,926 A 7/1991 Dieterich, Jr.
5,257,845 A * 11/1993 McConnell ..... 294/171
5,865,494 A * 2/1999 Tipp ..... 294/171
D442,085 S 5/2001 Bozlee
6,234,946 B1 * 5/2001 Fricano ..... 493/340
D451,390 S * 12/2001 Bozlee ..... D9/434
D451,391 S 12/2001 Bozlee
6,481,771 B1 * 11/2002 Friedman ..... 294/171
D502,872 S * 3/2005 Fleming ..... D9/434

FOREIGN PATENT DOCUMENTS

GB 2 202 135 A 9/1988
GB 2 241 432 A 9/1991
GB 2253995 * 9/1992 ..... 294/171

* cited by examiner

*Primary Examiner*—Dean J. Kramer
(74) *Attorney, Agent, or Firm*—Steptoe & Johnson LLP; Tyson York Winarski

(57) ABSTRACT

The invention is an ergonomic that attaches to a plastic bag. The ergonomic handle has at least two folds formed therein forming a flat bottom surface and a pair of side walls. Lower portions of the side walls are formed into bag arms that secure the plastic handles formed in the plastic bag.

14 Claims, 10 Drawing Sheets

ERGONOMIC PLASTIC BAG HANDLE

The present application claims priority under 35 U.S.C. § 120 to pending U.S. patent application Ser. No. 60/584,949, filed on Jun. 25, 2004, the disclosure of which is expressly incorporated by reference herein in its entirety.

FIELD OF THE INVENTION

The present invention relates to the field of handles and more particularly to a handle for a thin plastic consumer bag.

DISCUSSION OF BACKGROUND INFORMATION

The use of plastic bags is prolific in our consumer driven economy. Plastic bags are so cheap to produce, sturdy, plentiful, easy to carry and store that they have captured at least 80 percent of the grocery and convenience store market since they were introduced a quarter century ago. First introduced in the 1970s, plastic bags now account for four out of every five bags handed out at the grocery store. Based upon data released by the United States Environmental Protection Agency in 2001 on U.S. plastic bag, sack, and wrap consumption, somewhere between 500 billion and a trillion plastic bags are consumed worldwide each year. Plastic bags have eclipsed the use of paper bags for carrying purchased consumer goods. It costs one cent for a standard plastic grocery sack, whereas a paper bag costs four cents to manufacture.

Plastic bags are made from either Type 2 plastic (high-density polyethylene film—HDPE) or Type 4 plastic (low density or linear-low density polyethylene film—LDPE/LLDPE), both of which can be recycled. These plastic bags include a pair of plastic handles that are formed as a contiguous part of the plastic bag.

From grocery stores to retail stores, merchants place purchased goods in these cheap and plentiful plastic bags. Consumers gather these plastic bags and place them by hand into their vehicles to transport home. The bumps, turns, and jostling of the vehicle while travelling home can cause the contents of the plastic bag to shift. Jars of spaghetti sauce and cartons of milk can roll around the trunk and break once free of the confines of the plastic bag. Once at home and the trunk is opened, the consumer will have to rebag the goods that fell out of the bag from the journey. Consequently, there is a need to develop a handle that can attach to the plastic handles of the plastic bag to keep the bag closed during transit, thereby keeping the goods contained therein secure.

Weight is an important factor with plastic bags. The consumer has to hand carry the good laden plastic bags when transporting the goods to and from their vehicle. Many consumers will attempt to hand carry multiple good laden plastic bags in each hand at one time. The handles of these plastic bags are comprised portions of the sheet plastic that form the bags. When these plastic bags are loaded with a heavy amount of goods, the plastic bag handles tend to bunch up into a thin strip that is not very ergonomic and can cause discomfort and even pain to the hand of the consumer. Consequently, stores attempt to redistribute heavy loads of goods across multiple bags, thereby making the load of goods easier to carry. Moreover, this requires the use of additional bags, which adds to the cost of doing business for the merchant. Consequently, there is a need to develop an ergonomic handle that can attach to the plastic bag enabling consumers to carry heavily laden bags comfortably. In addition, by enabling consumers to carry heavier bags more comfortably, merchants can use fewer bags, thereby reducing operating costs.

Attaching an additional handle to a plastic bag takes time. If the process of attaching a handle to a plastic bag takes too much time, any cost savings from using the handle is lost due to the additional labor cost. Consequently, it is highly desirable to develop a handle configuration that is simple and can attach to a plastic bag swiftly.

The ability to sell advertising space to others can greatly improve the bottom line of any merchant. It is therefore desirable to develop a handle that can also display visual advertisements.

SUMMARY OF THE PRESENT INVENTION

The present invention is an ergonomic handle that attaches to a plastic bag. The ergonomic handle has at least two folds formed therein forming a flat bottom surface and a pair of side walls. The flat bottom surface rests comfortably in the consumers hand while the side walls provide additional ergonomic grip and comfort to the consumers palm and fingers. Lower portions of the side walls are formed into bag arms. These bag arms pivot along the folds formed in the ergonomic handle. Bending the side walls along the folds enable the bag arms to move between open and closed positions. When the side walls are bent into an open position, the plastic handles that are a contiguous portion of the plastic bag may be inserted through the ergonomic handle. Releasing the side walls from the open position allows the ergonomic handle to return to a closed position due to the elastic nature of the material that forms the ergonomic handle.

As the side walls pivot along the folds back into a closed position, the bag arms close around the plastic bag handles that are a contiguous part of the plastic bag. When in a closed position, the bag arms and bottom surface define an opening in which the plastic bag handles are confined. When the plastic bag handles are confined in this opening, the plastic bag is held in a locked condition such that any goods contained therein cannot generally come out of the bag during transport.

Additional folds may be provided in the upper portions of the sidewalls to create at least one upper flat surface. This upper flat surface or surfaces provide additional ergonomic support for the thumb and fingers.

DETAILED DESCRIPTION OF THE PREFERRED EMBODIMENTS

Figure 1:
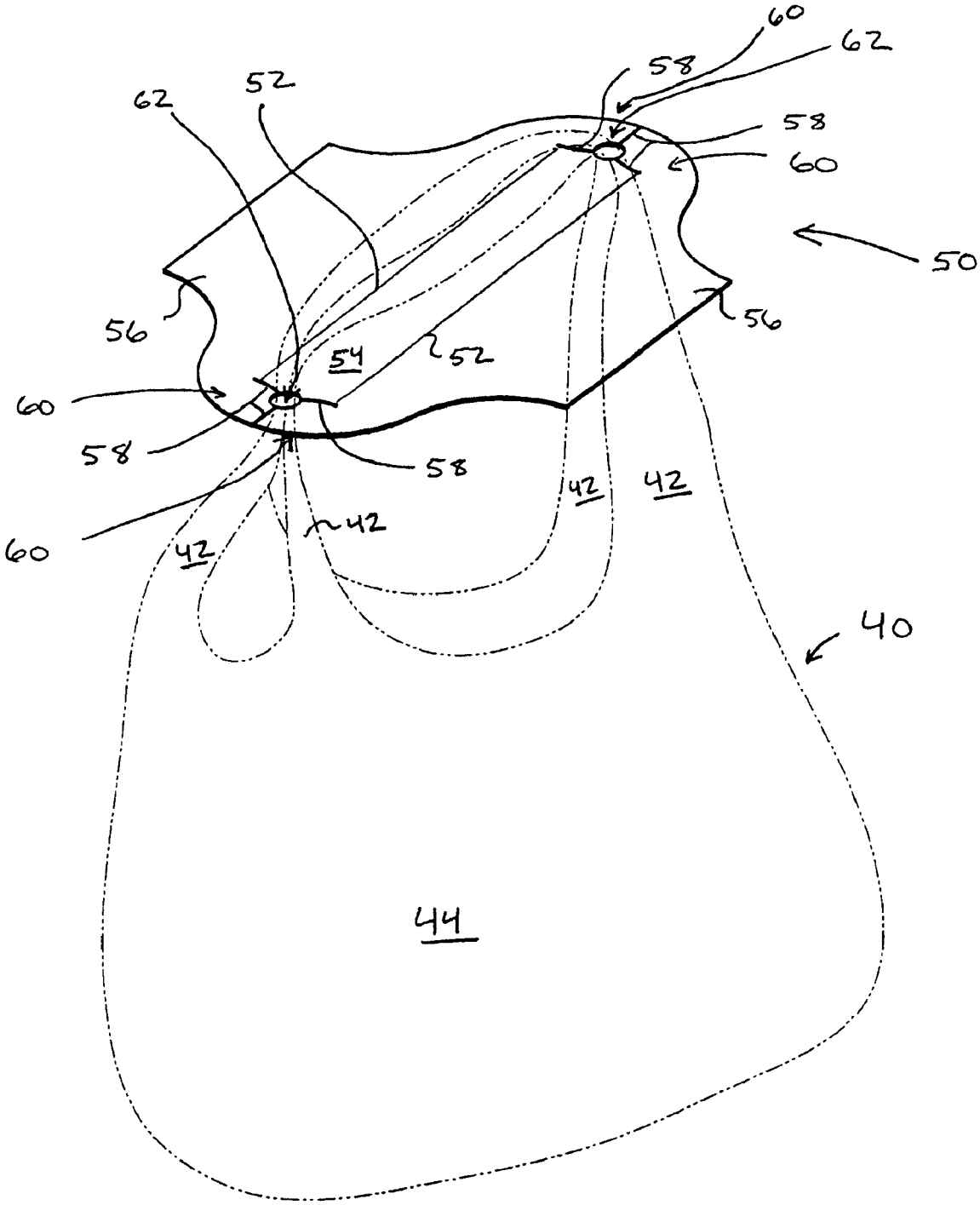
FIG. 1 depicts an ergonomic handle in a closed configuration attached to a plastic bag.

Referring to the Figures by characters of reference, a conventional thin sheet consumer plastic bag 40 is depicted in FIG. 1. Plastic bag 40 is commonly formed of either Type 2 plastic (high-density polyethylene film—HDPE) or Type 4 plastic (low density or linear-low density polyethylene film—LDPE/LLDPE), both of which can be recycled.

Plastic bag 40 includes plastic bag handles 42 that are a contiguous part of the bag carrying portion 44, referred to herein as bag 44. Plastic bag 40 includes two of such plastic bag handles 42. When plastic bag handles 42 are held together, goods contained in bag 44 are generally not able to get out of bag 44 when plastic bag 40 experiences jostling as it is transported by a consumer.

FIG. 1 depicts an ergonomic handle 50 in a closed configuration attached to plastic bag 40. Ergonomic handle 50 has two folds 52 formed therein, thereby dividing ergonomic handle 50 into three separate sections, which are the flat bottom surface 54, and pair of side walls 56. Ergonomic handle 50 is cut along lines 58 to enable side walls 56 to bend freely along folds 52 formed in ergonomic handle 50. Bag arms 60 are formed in the lower portion of side walls 56.

Bag arms engage plastic handles 42 of plastic bag 40. Bag arms 60 and flat bottom surface 54 are formed such that together, when ergonomic handle 50 is in a closed position, an opening 62 is defined. Plastic handles 42 extend through both openings 62. Together, bag arms 60 and flat bottom surface 54 constrain both plastic handles 42 within opening 62, thereby holding plastic bag 40 in a closed, or "locked" configuration. When in this closed or locked configuration, goods contained within bag 44 are generally unable to fall out of the bag, thereby improving the ability of bag 44 to hold goods.

Ergonomic handle 50 is typically made out of a paper product such as cardboard. Folds 52 are generally formed in ergonomic handle 50 by creasing the cardboard. Cuts 58 are generally formed by cutting the cardboard. Other conventional processes for forming folds 52 and cuts 58 are well known of those skilled in the art. Alternatively, ergonomic handle 50 may be formed of a plastic, or other suitable material.

Figure 2:
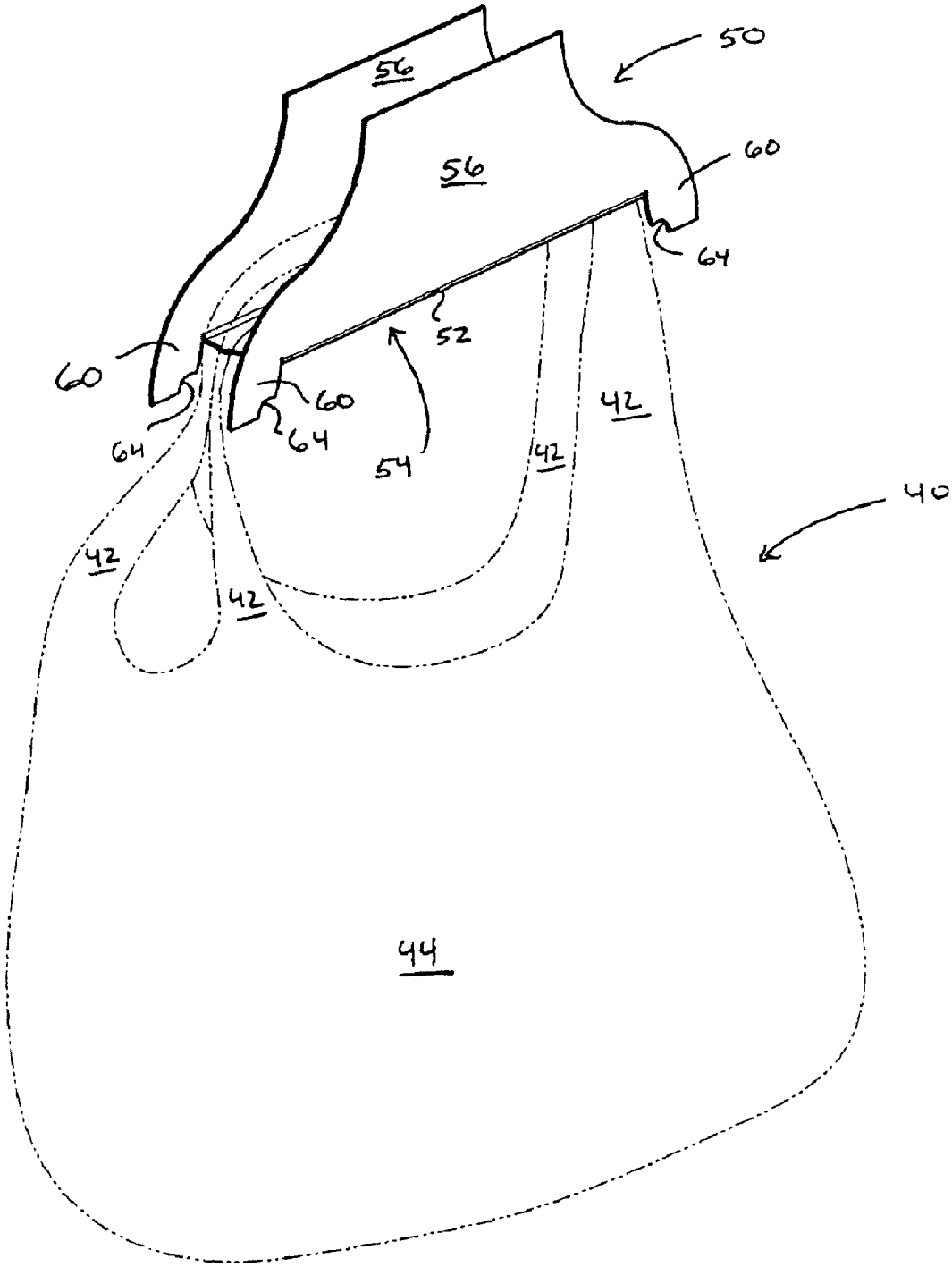
FIG. 2 depicts an ergonomic handle in an open configuration attached to a plastic bag.

FIG. 2 depicts an ergonomic handle in an open configuration attached to a plastic bag. In FIG. 2, side walls 56 are bent along folds 52 into an open position. In this open position, bag arms 60 are moved away from flat bottom surface 54, thereby "breaking" the opening formed by the combination of bag arms 60 and flat surface 54 when bag arms are in a closed position. Plastic handles 42 extend freely through the channel formed by side walls 56 and flat bottom surface 54.

By making ergonomic handle 50 out of cardboard, it is easy to bend side walls 56 into the open position shown. By virtue of the elastic and flexible nature of cardboard, ergonomic handle 50 exhibits "memory," whereby releasing side walls 56 from their open position allows the side walls to bend back along folds 52 into substantially the closed position illustrated in FIG. 1. A variety of plastics exhibit the same type of "memory," and are useable for manufacturing ergonomic handle 50. The use of a material such as cardboard or plastic that has memory enables ergonomic handle 50 to self lock on plastic bag 40, thereby reducing costly labor by store employees who place ergonomic handles 50 on plastic bags 40.

When a consumer carries plastic bag 40 by placing their hand on ergonomic handle 50, their hand will bend ergonomic handle 50 into a substantially open configuration as shown in FIG. 2. Flat bottom surface 54 of ergonomic handle 50 rests on the bottom surface of the consumer's hand while side walls 56 rest against the palm and fingers of the consumer's hand. Flat bottom surface 54 and side walls 56 shield the consumer's hand from the non-ergonomic shape of plastic handles 42, thereby increasing the comfort to the consumer as the consumer carries plastic bag 40.

When the consumer sets plastic bag 40 down and releases their hand from ergonomic handle 50, ergonomic handle 50 returns to a substantially closed position as illustrated in FIG. 1 due to the memory of the material used to form ergonomic handle 50. By virtue of this "self-locking" feature of ergonomic handle 50, plastic bag 40 remains closed so that goods may not generally fall out of bag 44.

When the consumer releases their hand from ergonomic handle 50, side walls 56 pivot along folds 52 back into a generally closed position. As side walls 56 pivot, bag arms 60 come closer together and begin to define opening 62 along with flat bottom surface 54. As bag arms 60 come together, plastic handles 42 are guided into position within defined opening 62, thereby constrain the movement of plastic handles 42.

Ergonomic handle 50 has the great advantage of being formed with flat surfaces that can support printed advertising.

Figure 3:
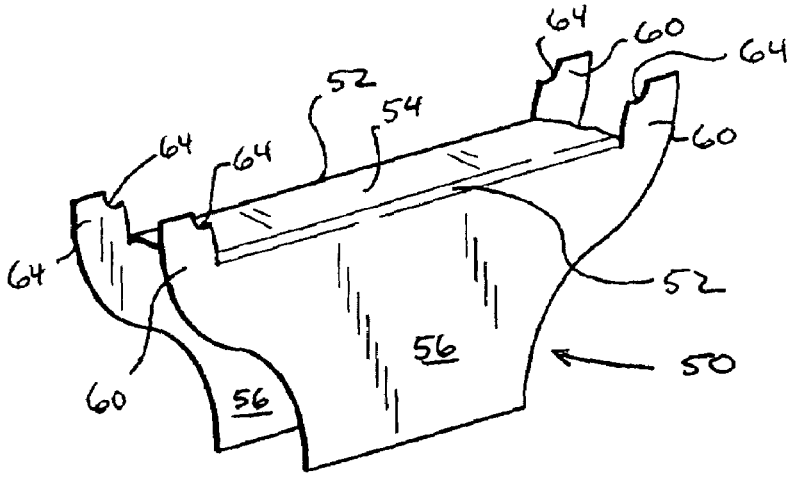
FIG. 3 depicts an isometric view of an ergonomic handle in an open position.

FIG. 3 depicts an isometric view of ergonomic handle 50 in an open position. Side walls 56 are bent into an open position forming generally a right angle with flat bottom surface 54 along folds 52. Bag arms 60 are illustrated as extending upward. Curved sections 64 of bag arms 60 define portions of opening 62.

Figure 4:
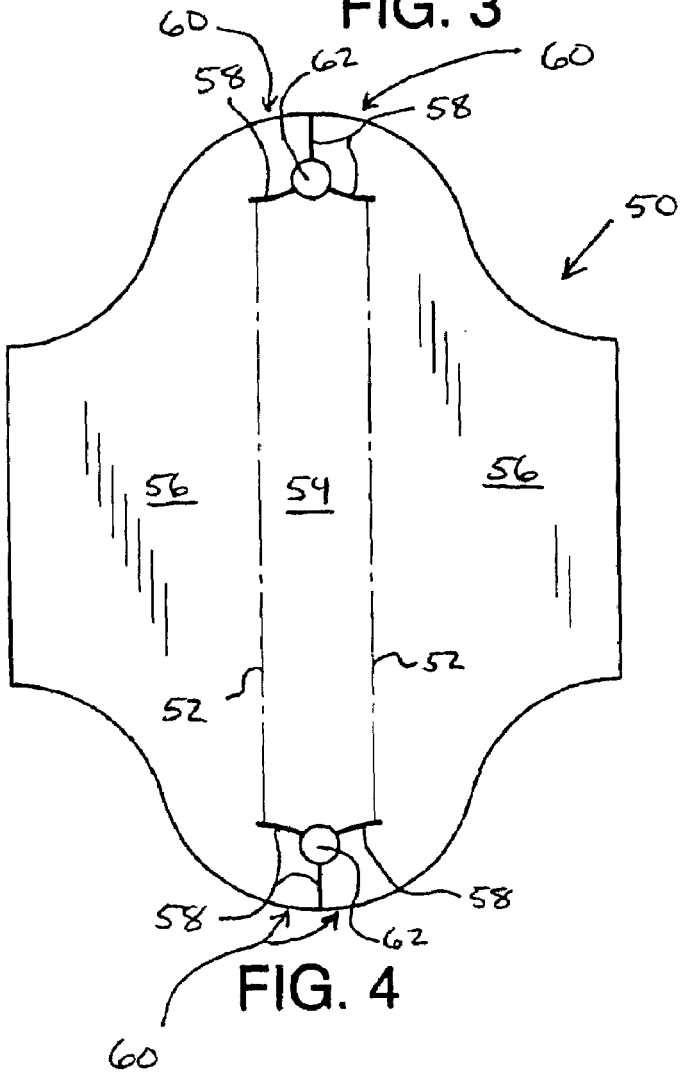
FIG. 4 depicts a top view of an ergonomic handle in a closed configuration.

FIG. 4 depicts a top view of ergonomic handle 50 in a closed configuration. In a substantially closed position, ergonomic handle 50 is essentially flat. Folds 52 are shown with dashed lines. Cuts 58 separate the pair of side walls 56 from each other, thereby enabling side walls 56 to pivot about folds 52. Openings 62 are defined by curved sections 64 formed in bag arms 60 and flat bottom surface 54.

Figure 5:
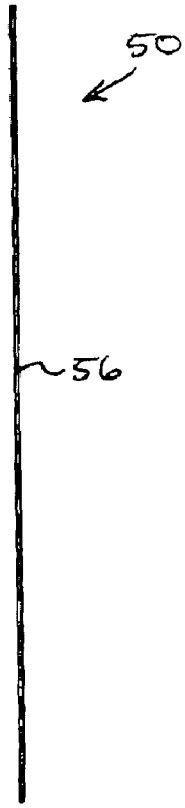
FIG. 5 depicts an edge view of an ergonomic handle in a closed configuration.

FIG. 5 depicts an edge view of ergonomic handle 50 in a closed configuration. As noted with respect to FIG. 4, ergonomic handle 50 is generally flat when in a closed configuration.

Figure 6:
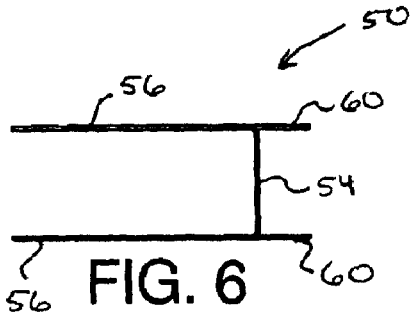
FIG. 6 depicts an end view of an ergonomic handle in an open configuration.

FIG. 6 depicts an end view of ergonomic handle 50 in an open configuration. Side walls 56 are bent along folds 52, thereby generally forming a "U" shaped handle with flat bottom surface 54 in which plastic handle 42 (not shown) can pass through for transport.

Figure 7:
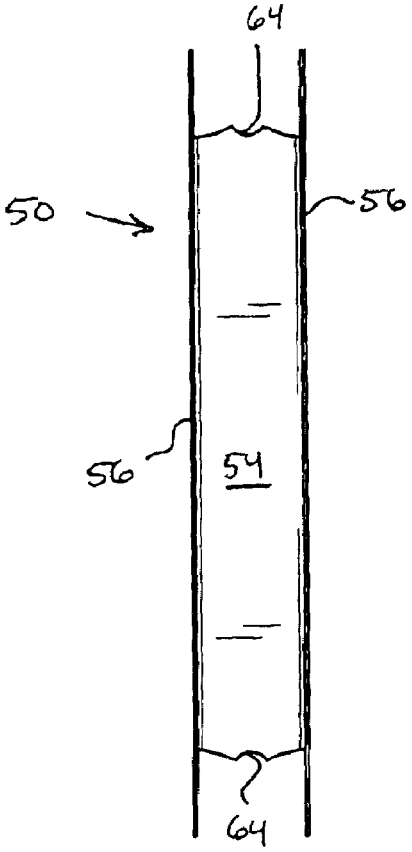
FIG. 7 depicts a top view of an ergonomic handle in an open configuration.

FIG. 7 depicts a top view of an ergonomic handle in an open configuration. The edges of side walls 56 run parallel to each other. Curved sections 64 of flat bottom surface define a portion of opening 62. Note that while side walls 56 are shown to be generally at a right angle with respect to flat bottom surface 54 when in an open configuration, side walls 56 may be positioned at any angle with respect to flat bottom surface 54 to be an open position so long as there is sufficient space between bag arms 60 for plastic handles 42 to pass into openings 62.

Figure 8:
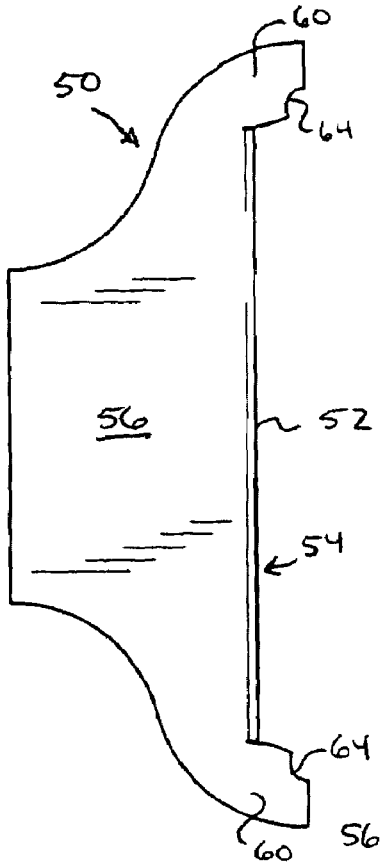
FIG. 8 depicts a side view of an ergonomic handle in an open configuration.

FIG. 8 depicts a side view of ergonomic handle 50 in an open configuration. Side wall 56 is provided with bag arms 60 to constrain plastic handles 42. Curved section 64 of bag arms 60 define a portion of opening 62. Fold 52 enables side wall 56 to bend with respect to flat bottom surface 54.

Figure 9:
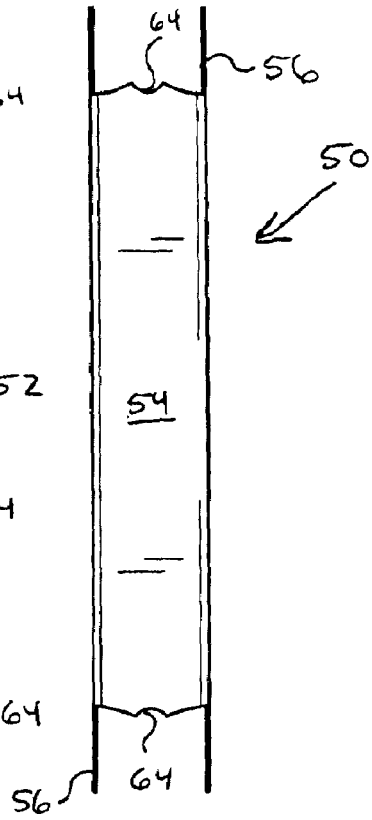
FIG. 9 depicts a bottom view of an ergonomic handle in an open configuration.
Figure 10:
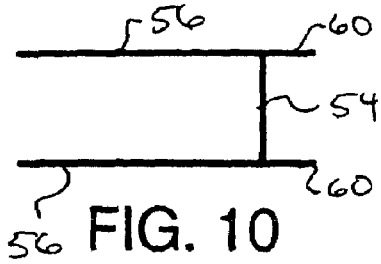
FIG. 10 depicts an end view of an ergonomic handle in an open configuration.

FIG. 9 depicts a bottom view of ergonomic handle 50 in an open configuration. FIG. 10 depicts an end view of an ergonomic handle in an open configuration.

Figure 11:
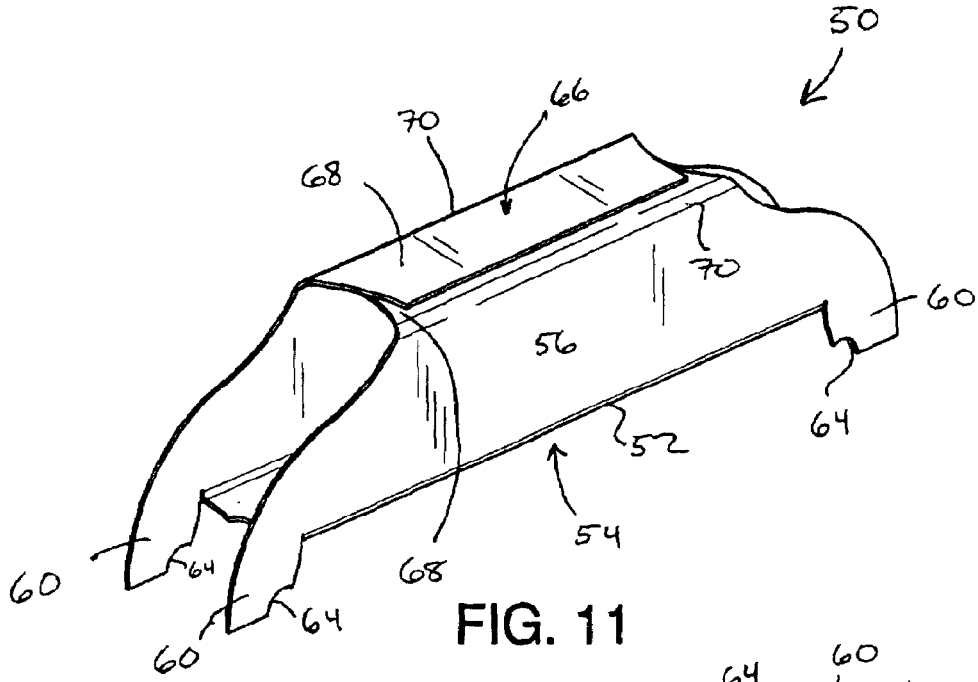
FIG. 11 depicts a top isometric view of an ergonomic handle having an upper flat surface.

FIG. 11 depicts a top isometric view of a preferred ergonomic handle 50 having an upper flat surface 66. Upper flat surface is made from a pair of flaps 68 that are formed from an upper portion of side walls 56. Side walls 56 are provided with folds 70 to enable flaps 68 to bend over each other and form upper flat surface 66. Upper flat surface 66 enhances the ergonomic qualities of ergonomic handle 50 by providing a smooth flat surface upon which a consumer can rest their thumb and fingers against.

Figure 12:
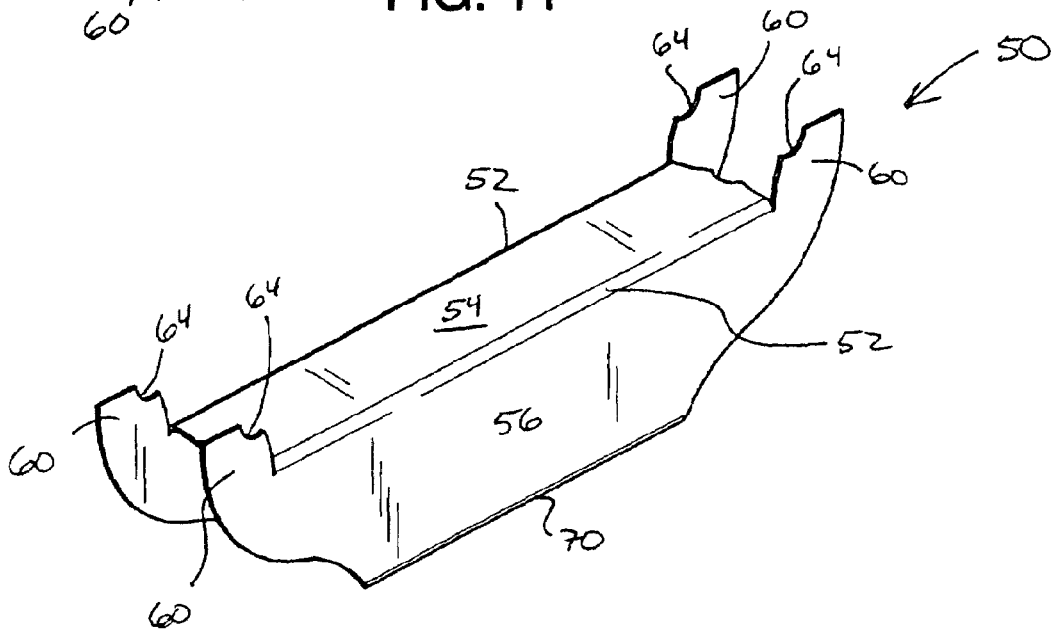
FIG. 12 depicts a bottom isometric view of an ergonomic handle having an upper flat surface.

FIG. 12 depicts a bottom isometric view of ergonomic handle 50 having upper flat surface 66. Folds 70 enable flaps 68 formed from the upper portion of side walls 56 to provide upper flat surface 66. Curved section 64 of bag arms 60 define a portion of opening 62.

Figure 13:
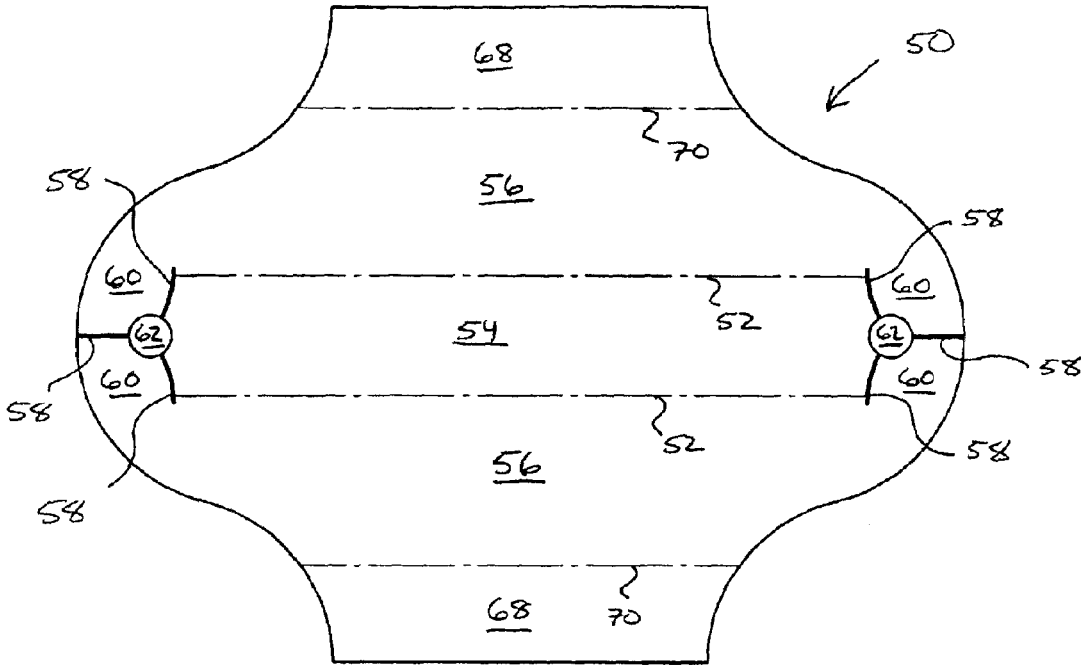
FIG. 13 depicts a top view of an ergonomic handle having an upper flat surface.

FIG. 13 depicts a top view of ergonomic handle 50 having upper flat surface 66. Folds 70 form flaps 68 in side walls 56. Cuts 58 and folds 52 enable side walls 56 to bend with respect to flat bottom surface 54. Openings 62 constrain plastic handles 42 when plastic handles 42 extend therein. In FIG. 13, ergonomic handle 50 is in a closed configuration.

Figure 14:
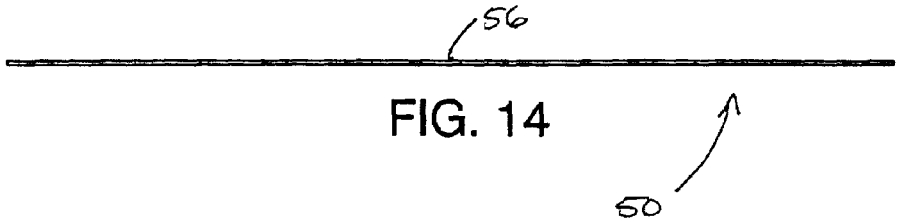
FIG. 14 depicts an edge view of an ergonomic handle having an upper flat surface.

FIG. 14 depicts an edge view of ergonomic handle 50 having upper flat surface 66. When in a substantially closed configuration as illustrated in FIG. 14, ergonomic handle 50 is substantially flat.

Figure 15:
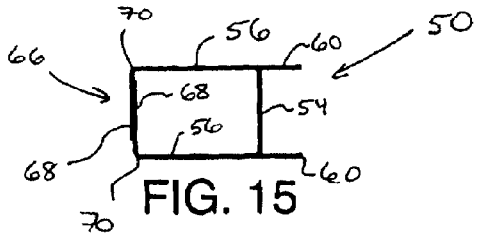
FIG. 15 depicts a right end view of an ergonomic handle having an upper flat surface.

FIG. 15 depicts a right end view of ergonomic handle 50 having upper flat surface 66. Flaps 68 overlap each other to form flat surface 66. Overlapping flaps 68 also enable side walls 56 to remain substantially parallel to each other in the open position illustrated when a consumer carriers plastic bag 40 with ergonomic handle 50. By keeping ergonomic handle 50 in an open square-like configuration as illustrated in FIG. 15, the ergonomic qualities of ergonomic handle 50 are improved by flaps 68.

Figure 16:
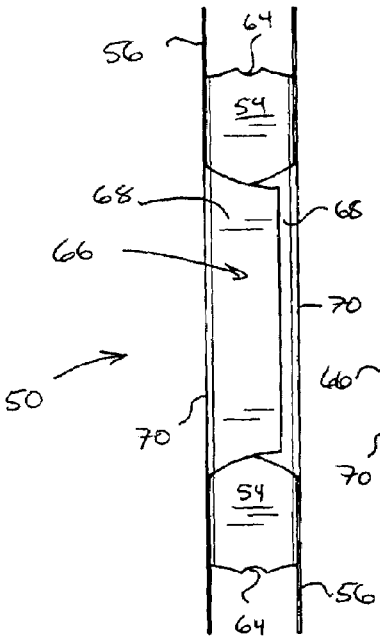
FIG. 16 depicts a top view of an ergonomic handle having an upper flat surface.

FIG. 16 depicts a top view of ergonomic handle 50 having upper flat surface 66. Flaps 68 overlap to form upper flat surface 66. Folds 70 form flaps 68 in side walls 56. Curved sections 64 of flat bottom surface define a portion of opening 62.

Figure 17:
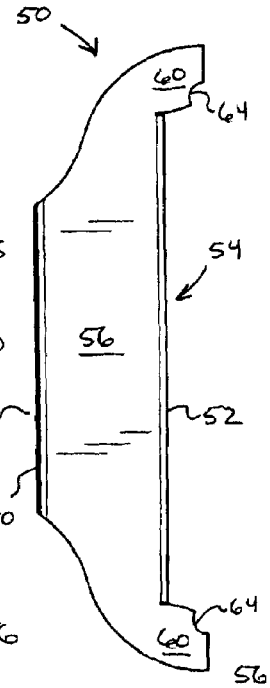
FIG. 17 depicts a side view of an ergonomic handle having an upper flat surface.

FIG. 17 depicts a side view of an ergonomic handle having an upper flat surface. Folds 52 and 70 form side walls 56 and flaps 68. Curved sections 64 of flat bottom surface define a portion of opening 62.

Figure 18:
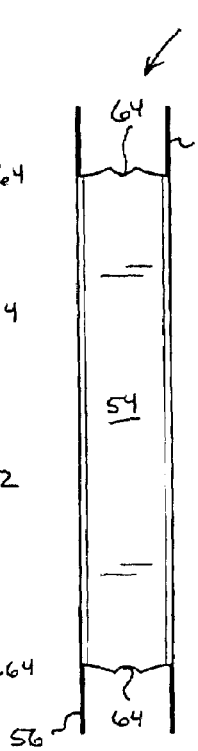
FIG. 18 depicts a bottom view of an ergonomic handle having an upper flat surface.
Figure 19:
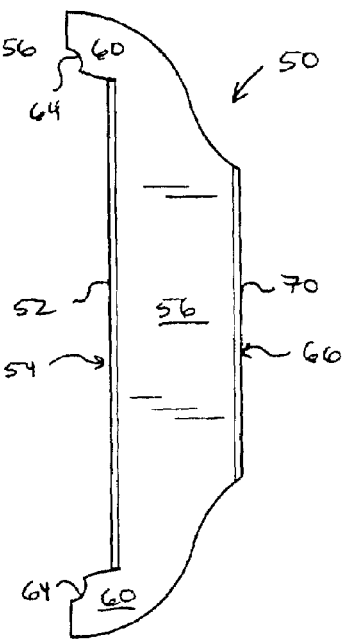
FIG. 19 depicts a side view of an ergonomic handle having an upper flat surface.
Figure 20:
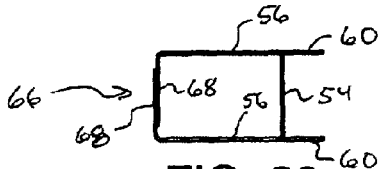
FIG. 20 depicts a left end view of an ergonomic handle having an upper flat surface.

FIG. 18 depicts a bottom view of ergonomic handle 50 having upper flat surface 66. FIG. 19 depicts a side view of ergonomic handle 50 having upper flat surface 66. FIG. 20 depicts a left end view of ergonomic handle 50 having upper flat surface 66.

Figure 21:
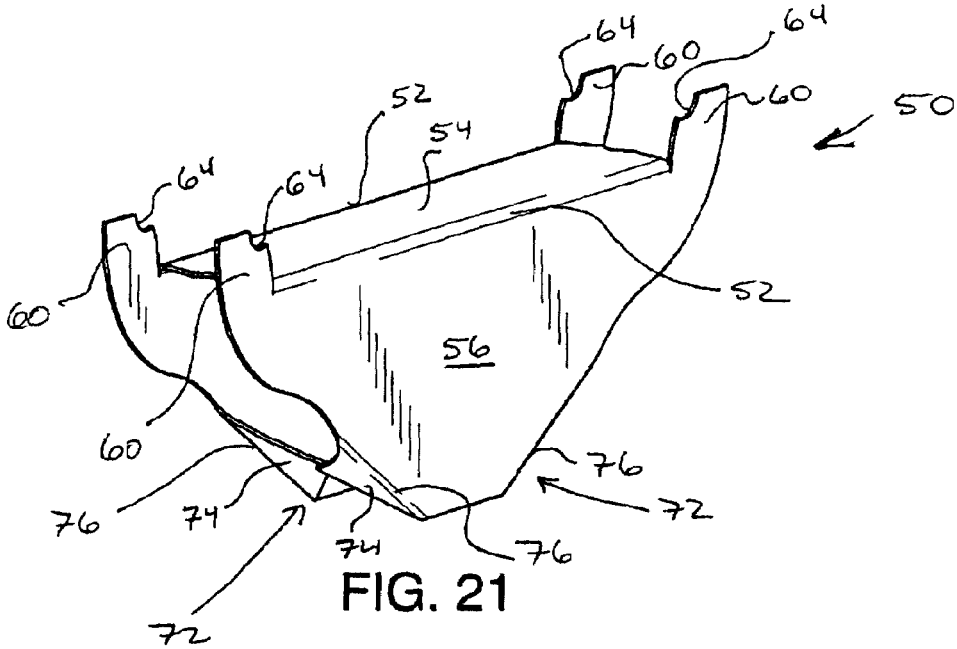
FIG. 21 depicts a bottom isometric view of an ergonomic handle having a pair of angled upper flat surfaces.
Figure 22:
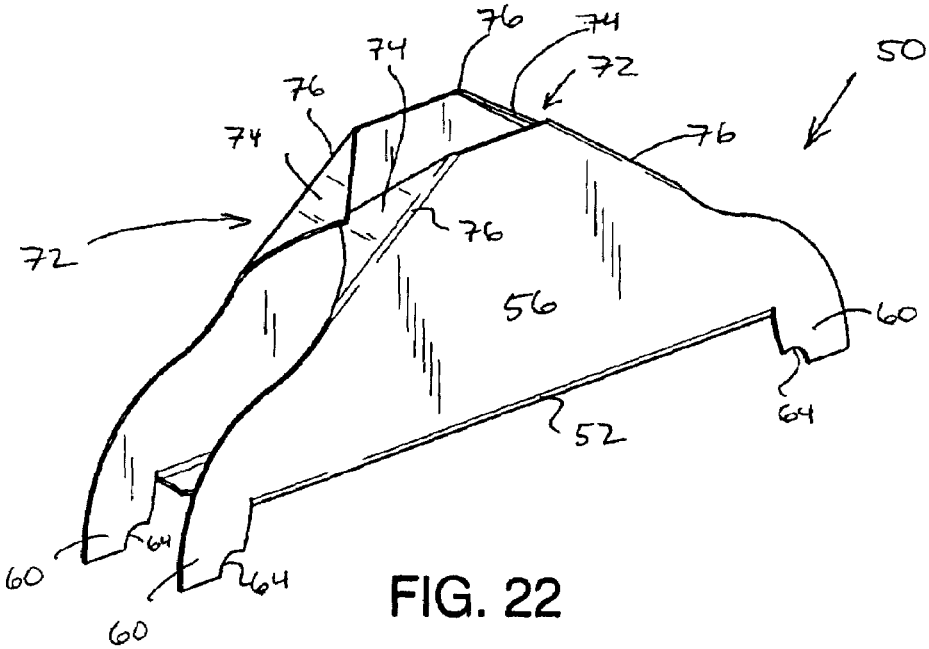
FIG. 22 depicts a top isometric view of an ergonomic handle having a pair of angled upper flat surfaces.

FIG. 21 depicts a bottom isometric view of ergonomic handle 50 having a pair of angled upper flat surfaces 72. Upper flat surfaces 72 are formed from overlapping flaps 74. Overlapping flaps 74 are formed in the upper portion of side walls 56 with folds 76. Upper flat surfaces 72 provide an smooth surface for the thumb or fingers of a consumer's hand to rest against, thereby improving the ergonomic qualities of ergonomic handle 50. FIG. 22 depicts a top isometric view of ergonomic handle 50 having pair of angled upper flat surfaces 72. Curved sections 64 of bag arms 60 define portions of opening 62 when ergonomic handle 50 is in a closed position.

Figure 23:
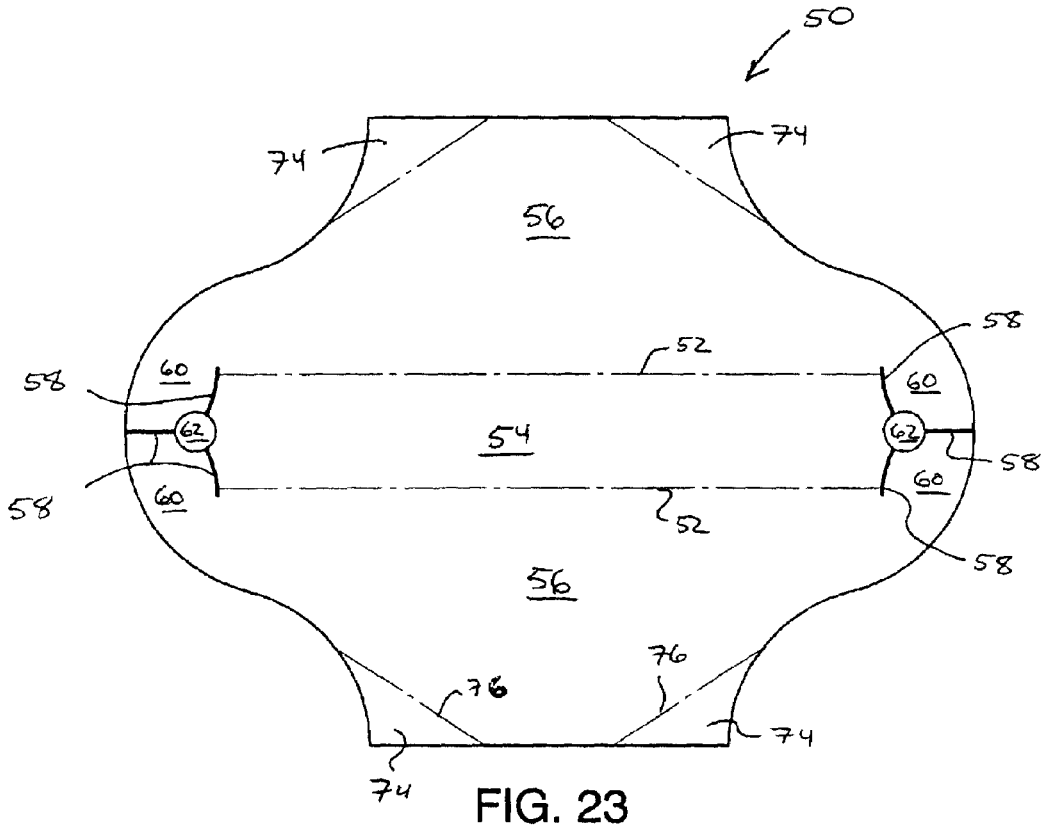
FIG. 23 depicts a top view of an ergonomic handle having a pair of angled upper flat surfaces.
Figure 24:
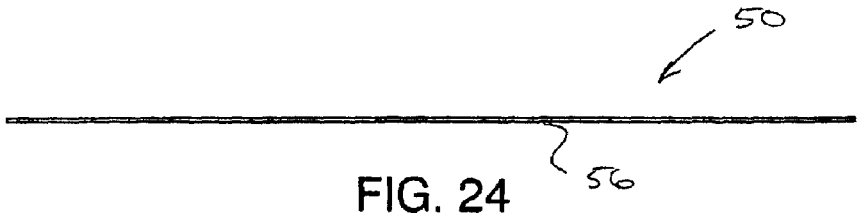
FIG. 24 depicts an edge view of an ergonomic handle having a pair of angled upper flat surfaces.

FIG. 23 depicts a top view of ergonomic handle 50 having pair of angled upper flat surfaces 72. Folds 76 form flaps 74 from the upper portions of side walls 56. Ergonomic handle 50 is illustrated in this figure in a substantially closed configuration. FIG. 24 depicts an edge view of ergonomic handle 50 having pair of angled upper flat surfaces 72. When in a generally closed configuration, ergonomic handle 50 is substantially flat.

Figure 25:
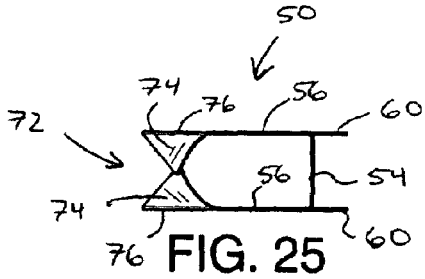
FIG. 25 depicts a right end view of an ergonomic handle having a pair of angled upper flat surfaces.
Figure 26:
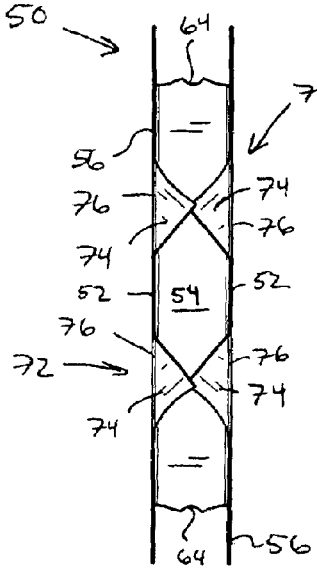
FIG. 26 depicts a top view of an ergonomic handle having a pair of angled upper flat surfaces.
Figure 27:
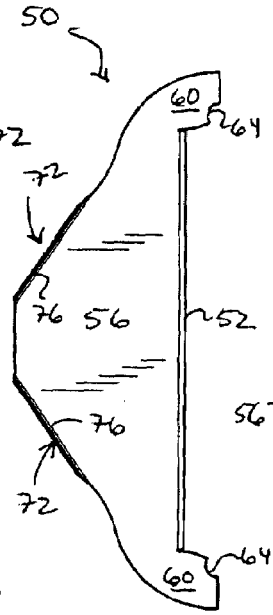
FIG. 27 depicts a side view of an ergonomic handle having a pair of angled upper flat surfaces.
Figure 28:
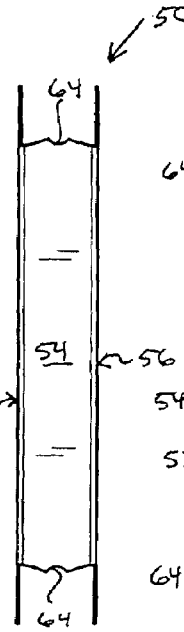
FIG. 28 depicts a bottom side view of an ergonomic handle having a pair of angled upper flat surfaces.
Figure 29:
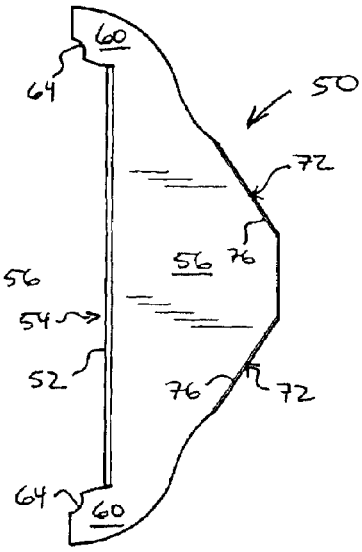
FIG. 29 depicts a side view of an ergonomic handle having a pair of angled upper flat surfaces.
Figure 30:
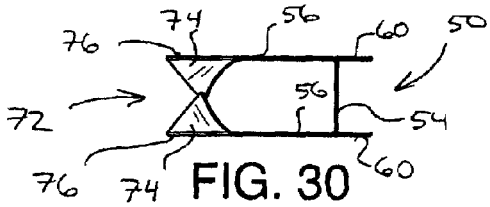
FIG. 30 depicts a left end view of an ergonomic handle having a pair of angled upper flat surfaces.

FIG. 25 depicts a right end view of ergonomic handle 50 having pair of angled upper flat surfaces 74. Flaps 74 are formed from side walls 56 with folds 76, thereby providing an ergonomic surface for the consumer's hand. FIG. 26 depicts a top view of ergonomic handle 50 having pair of angled upper flat surfaces 72. Upper flat surfaces 72 are formed from overlapping flaps 74. FIG. 27 depicts a side view of ergonomic handle 50 having pair of angled upper flat surfaces 72. FIG. 28 depicts a bottom side view of ergonomic handle 50 having pair of angled upper flat surfaces 72. FIG. 29 depicts a side view of ergonomic handle 50 having pair of angled upper flat surfaces 72. FIG. 30 depicts a left end view of ergonomic handle 50 having pair of angled upper flat surfaces 72.

Having fully described the invention with referred to the preferred embodiments illustrated in the attached drawing Figures, it will be really appreciated by those skilled in the art that many changes and modifications may be made to the invention without departing from the essence of the invention and without being included within the spirit and scope of the invention as is defined by the appended claims.

What is claimed is:

1. A handle for holding a bag handle, comprising:

a flat bottom surface;

a first side wall;

a second side wall, said first and second side walls are flexibly attached to opposite sides of said flat bottom surface, whereby said first and second side walls may be flexed between a closed position where said flat bottom surface and said first and second side walls are substantially planar, and an open position where said flat bottom surface and said first and second side walls generally form a "U" shape;

a bag arm formed at each end of said first and second side walls, said bag arms from said first side wall are adjacent to said bag arms from said second side wall, when said handle is in the closed position said bag arms from said first and second side wall abut each other and define a pair of openings with said flat bottom surface, when said handle is in the open position said bag arms do not abut each other and said handle may be placed onto said bag handle, said bag arms and said flat bottom surface hold said bag handle within the pair of openings when said handle is in the closed position;

a pair of flaps capable of being bent to form a flat top surface parallel to said flat bottom surface, said pair of flaps formed in said first and second side walls; and said first and second side walls extend entirely below said flat top surface to said flat bottom surface.

2. The handle of claim 1, said handle is made from a partially elastic material, whereby said side walls return to a substantially closed position when released from the open position.

3. The handle of claim 1, said pair of flaps overlap each other when said handle is in the closed position.

4. The handle of claim 1, wherein said pair of flaps comprised of a first flap and a second flap, said first flap formed in a top portion of said first side wall, said first flap extends the full length of the top portion of said first side wall, said second flap formed in a top portion of said second side wall, said second flap extends the full length of the top portion of said second side wall.

5. The handle of claim 1, wherein said handle has a rectangular cross-section when said handle is in an open position and said pair of flaps overlap to form said flat top surface.

6. The handle of claim 1, wherein said pair of flaps are both bent inwards over each other to form said flat top surface.

7. The handle of claim 1, wherein said flat top surface is an ergonomic surface for engaging a hand of a person.

8. A handle for holding a bag handle, comprising:

a sheet of material with two parallel folds formed therein, thereby defining a flat bottom surface and a first and second side wall, whereby said first and second side walls may be bent between a closed position where said flat bottom surface and said first and second side walls are substantially planar and an open position where said first and second side walls are generally parallel to each other;

a bag arm formed at each end of said first and said second side wall, said bag arms from said first side wall are adjacent to said bag arms from said second side wall, when said handle is in the closed position said bag arms from said first and second side wall define a pair of windows with said flat bottom surface, said handle can be placed onto said bag handle when said handle is in the open configuration, said bag arms and said flat bottom surface hold said bag handle within each window when said handle is in the closed position;

a pair of flaps capable of being bent to form a flat top surface parallel to said flat bottom surface, said pair of flaps formed in said first and second side walls; and said first and second side walls extend entirely below said flat top surface to said flat bottom surface.

9. The handle of claim 8, said handle is made from a partially elastic material, whereby said side walls return to a substantially closed position when released from the open position.

10. The handle of claim 8, said pair of flaps overlap each other when said handle is in the closed position. said handle is in the closed position.

11. The handle of claim 8, wherein said pair of flaps comprised of a first flap and a second flap, said first flap formed in a top portion of said first side wall, said first flap extends the full length of the top portion of said first side wall, said second flap formed in a top portion of said second side wall, said second flap extends the full length of the top portion of said second side wall.

12. The handle of claim 8, wherein said handle has a rectangular cross-section when said handle is in an open position and said pair of flaps overlap to form said flat top surface.

13. The handle of claim 8, wherein said pair of flaps are both bent inwards over each other to form the flat top surface.

14. The handle of claim 8, wherein said flat top surface is an ergonomic surface for engaging a hand of a person.

* * * * *